United States Patent [19]

Odom

[11] Patent Number: 4,920,853

[45] Date of Patent: May 1, 1990

[54] SHOT MEASURE FOR SHELL RELOADER ACCESSORY

[76] Inventor: Joel M. Odom, 6830 59th St., Tulsa, Okla. 74145

[21] Appl. No.: 374,991

[22] Filed: Jul. 3, 1989

Related U.S. Application Data

[63] Continuation-in-part of Ser. No. 337,257, Apr. 13, 1989.

[51] Int. Cl.[5] ..... F42B 33/02

[52] U.S. Cl. ..... 86/33; 86/31

[58] Field of Search ..... 86/23, 24, 29, 31, 33; 221/265

[56] References Cited

U.S. PATENT DOCUMENTS

| | | | |
|---|---|---|---|
| 209,956 | 11/1878 | Card | 86/29 |
| 231,753 | 8/1880 | Belcher | 86/29 |
| 2,749,790 | 6/1956 | Miller | 86/29 |
| 3,105,408 | 10/1963 | Bachhuber | 86/29 |
| 3,157,086 | 11/1964 | Bachhuber | 86/31 |
| 3,361,024 | 1/1968 | Sherrill, Jr. | 86/33 |

*Primary Examiner*—Charles T. Jordan

*Attorney, Agent, or Firm*—John Gassett

[57] ABSTRACT

An accessory for use with a home shell reloading machine to obtain dual shot size shells.

3 Claims, 18 Drawing Sheets

SHOT MEASURE FOR SHELL RELOADER ACCESSORY

RELATED APPLICATION

This is a Continuation-In-Part of my co-pending application 07/337,257, filed 04/13/89, and entitled "Shotgun Shell Reloader Accessory".

DISCLOSURE STATEMENT

The more pertinent prior disclosures are generally discussed in the Background section of this application.

BACKGROUND OF THE INVENTION

Field:

This invention relates to reloading shotgun shells and especially to reloading with a plurality of shot sizes.

The use of shotguns for target practicing, skeet shooting, or hunting is widely used in this country and indeed throughout the world. The case or housing of shotgun shells is very durable. In fact, many shotgun users save the housing after firing the shells. They take these used housings and reload them themselves, many times in their own garages. These housings can usually be reloaded up to ten or more times. It is much less costly to reload a housing then it is to buy new shells. Reloading machines are commercially available. One such reloader is sold by Mayville Engineering Company, Inc., of Mayville, Wis., and is designated MEC 650.

Recently a major supplier of shotgun shells has marketed factory loaded shells that combine two shot sizes in one shell.

Object of the Invention:

It is an object of this invention to provide an apparatus to permit home loading of multiple shot size loading of shotgun shells.

SUMMARY OF THE INVENTION

This is an accessory for use with a home shotgun shell reloader which has a relatively circular shell carrier that carries used empty shells in an upright position. Operating a hand lever causes the empty shell (with a primer previously added) to be progressively moved from a position where gun powder is placed in the shell, then a wad, and then a load of shot. The shot is dropped from a measure through a drop tube. The crimp is then put in the end of the housing. The shell is then ready to be used.

In one embodiment I use an accessory to add two difference size layers of shot. I support two separate shot containers above a measure which has a measure charge bar to two separate spaced apart charge holes. When the bar is pushed in one direction, shot from the first container enters the first charge hole. When the bar is pushed in the other direction the first charge hole is aligned with a drop tube so that shot may drop into the shell being loaded and the second charge hole is aligned with the second shot container to receive shot from that container. When the charge bar is pushed in the other direction a second size shot is dropped in the first size shot and shot in the first charge hole drops into the drop tube. The drop tube is provided with an articulated downwardly sloping hollow arm whose lower end is directed to be just above the shell hull to be filled. After the hull is filled with the two layer shot the articulated hollow arm is moved to one side and the reloader is activated to crimp the hull.

Another embodiment is especially useful for loading large steel shot such as TTT, TT, T, BB or No. 1 size. This includes a shot container above the measure. The bottom of the container has a shot drop hole. Just above the container bottom is a flat rotatable charge wheel with a charge slot. This slot can be rotated to be either aligned or unaligned with the container shot drop hole. A cover plate of about ½ the area of the container bottom is positioned just above the charge wheel. A handle is provided to rotate the charge wheel. When the charge wheel is in one position, shot fills the shot slot of the charge wheel. Further rotation of the charge wheel places the shot charge slot above the shot drop hole of the shot container and the shot drops into a measure hole of the charge bar of the measure. Then the charge bar is moved to empty the shot with the shot drop tube.

As an especially preferred embodiment I use a charge wheel which is modified from that just described above. This charge wheel does not have a charge slot but rather has a plurality of shot receiving holes. Each hole is of a size to receive one and only one shot of the size selected to be loaded into the shell hull. The number of holes determines the number of shots so loaded. The charge wheel is exposed to the shot in the container above the cover plate. The holes in the charge plate each receives a shot. The charge plate is then rotated over the shot drop hole of the container and into a shell hull which is positioned below the container. An exact loading of the selective number of shot of the selection size is thus loaded.

BRIEF DESCRIPTION OF THE DRAWINGS

FIG. 16 through 27C show another embodiment for loading a measure amount of shot into the measure bar.

FIG. 16 is a full face view of the modified shot container for dropping a measured amount of shot in the measure.

FIG. 17 is similar to FIG. 16 except is shows the side cover of the measure removed to illustrate the measure bar.

FIG. 18 is similar to FIG. 17 except the measure bar is in a different position.

FIG. 19 is a schematic front view showing the relative vertical position of the container, charge wheel and cover plate.

FIG. 20 is similar to FIG. 19 except the charge wheel has been rotated.

FIG. 21 is similar to FIG. 20 except that shot is also shown.

FIG. 22 is similar to FIG. 20 except that shot is also shown.

FIG. 27C is a view of the bottom of the shot container showing the shot drop hole.

DETAILED DESCRIPTION

Figure 1:
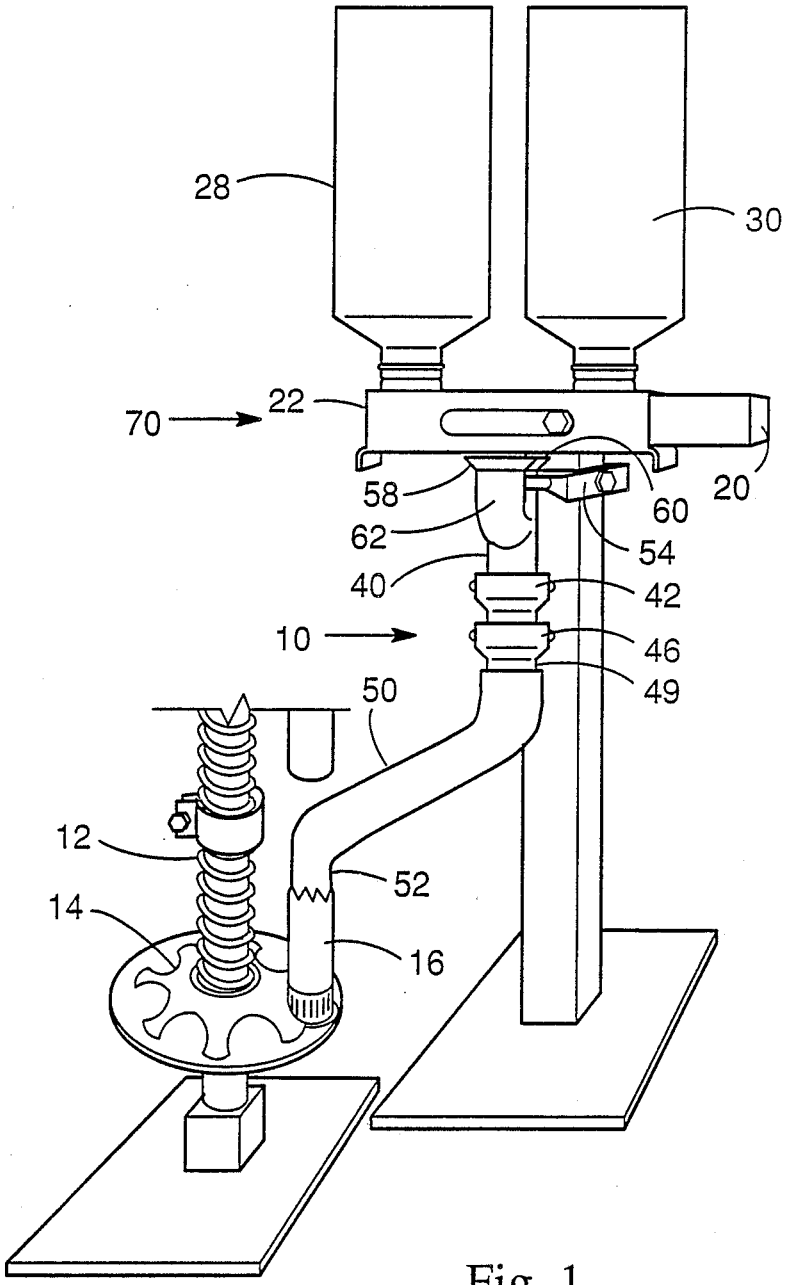
FIG. 1 is a view showing my shot loading accessory in use with a shell hull carried by a conventional shell reloader.

Attention is first directed to FIG. 1 which shows my shot loading accessory 70 for use with a conventional shotgun shell reloader 12 such as Model MEC 650 manufactured and sold by Mayville Engineering Company, Inc., Mayville, Wis. This reloader 12 has a shell carrier 14 which carries a plurality of shell hulls 16 in an upright position. In conventional operations of this particular reloader hull 16 will have been provided with primer, powder and wad shot cup combination by the time the hull reaches the position shown in FIG. 1. The hull is now ready for the loading of shot. The MEC 650 can be used to add shot but can not be used to load a hull having two layers of different size shots, e.g., No. 8 and a No. 7½. If I wish to have two size loading I use my loading accessory 70.

Figure 14:
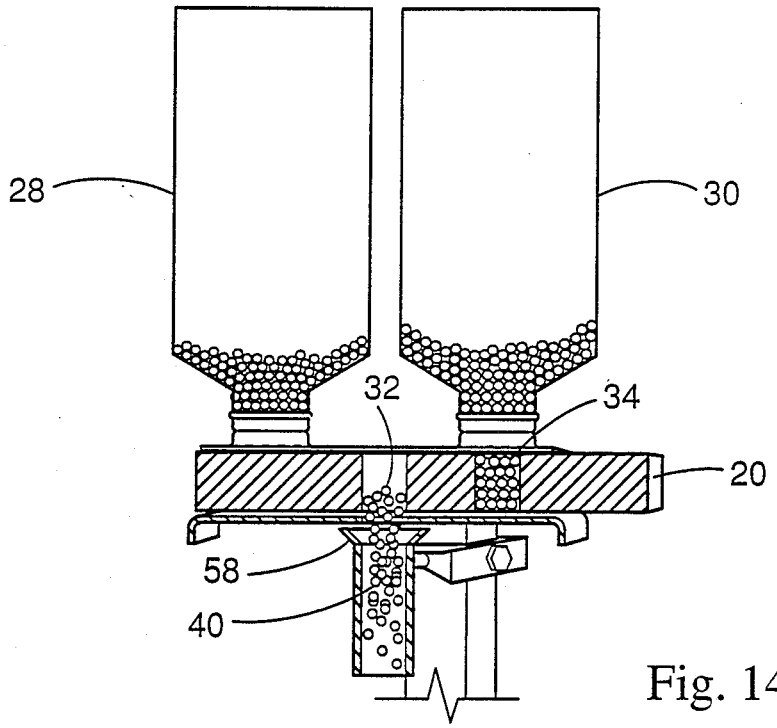
FIG. 14 shows one hole in the measure charge bar being filled and the second hole emptying.
Figure 15:
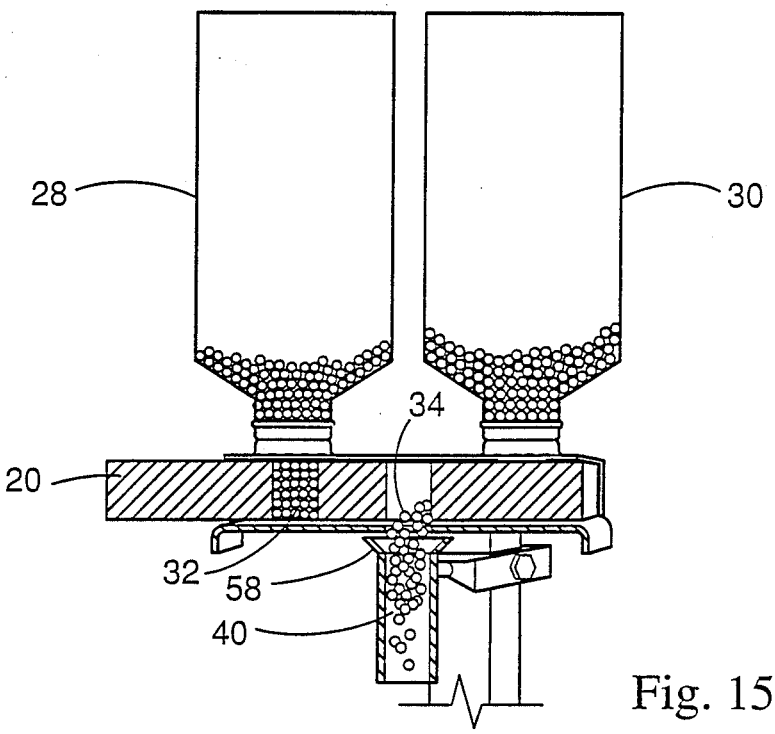
FIG. 15 shows the first hole in the measure bar being filled and the second hole emptying.

This accessory 70 includes a measure 18 having measure bar 20 in housing 22 and mounted on upright support 26. Two shot containers 28 and 30 are mounted on measure housing 22. As shown in FIGS. 14 and 15, measure bar 20 has two vertical holes 32 and 34 which in one position of bar 20 as shown in FIG. 14, hole 34 is aligned with shot container 30 and hole 32 is aligned with shot drop tube funnel 58. When measure bar 20 is in the position shown in FIG. 15, bar hole 32 is aligned with container 28 and bar hole 34 is aligned with shot drop tube funnel 58. In the position of FIG. 14 one size shot is dropped into hole 34 from container 30 and by moving the bar 20 to the position of FIG. 15 a different size shot is dropped from container 28. Thus, with this embodiment of my invention I have two different size shot dropped by gravity into drop shot tube funnel 58 by moving bar 20 in each direction.

As shown in FIG. 1 an articulated shot drop tube 10 directs the shot into hull 16. This includes funnel 58 with upright tube 40 to which a second funnel 42 is connected by pin 44. A third funnel 46 is connected to the upright tube of funnel 42 by pin 48. A downwardly sloping load tube 50 is connected to vertical tube 49 of funnel 46. Load tube 50 has a downward directed section 52 which fits the top of hull 16. Thus, when hull 16 reaches the position of FIG. 1, the load tube 50 can be directed to the position shown in FIG. 1. Then by merely pushing measure bar 20 in both directions shot from container 28 and then shot from container 30 will be dropped as two separate levels of different size shot into hull 16. By properly selecting the size shot put in containers 28 and 30, one gets the desired double or duplex shot load. Then I remove load tube 50 from hull 16. I next operate the MEC 650 reloader to cause the wad to be properly crimped. Hull 16 has now become a reloaded hull ready for use.

Figure 3:
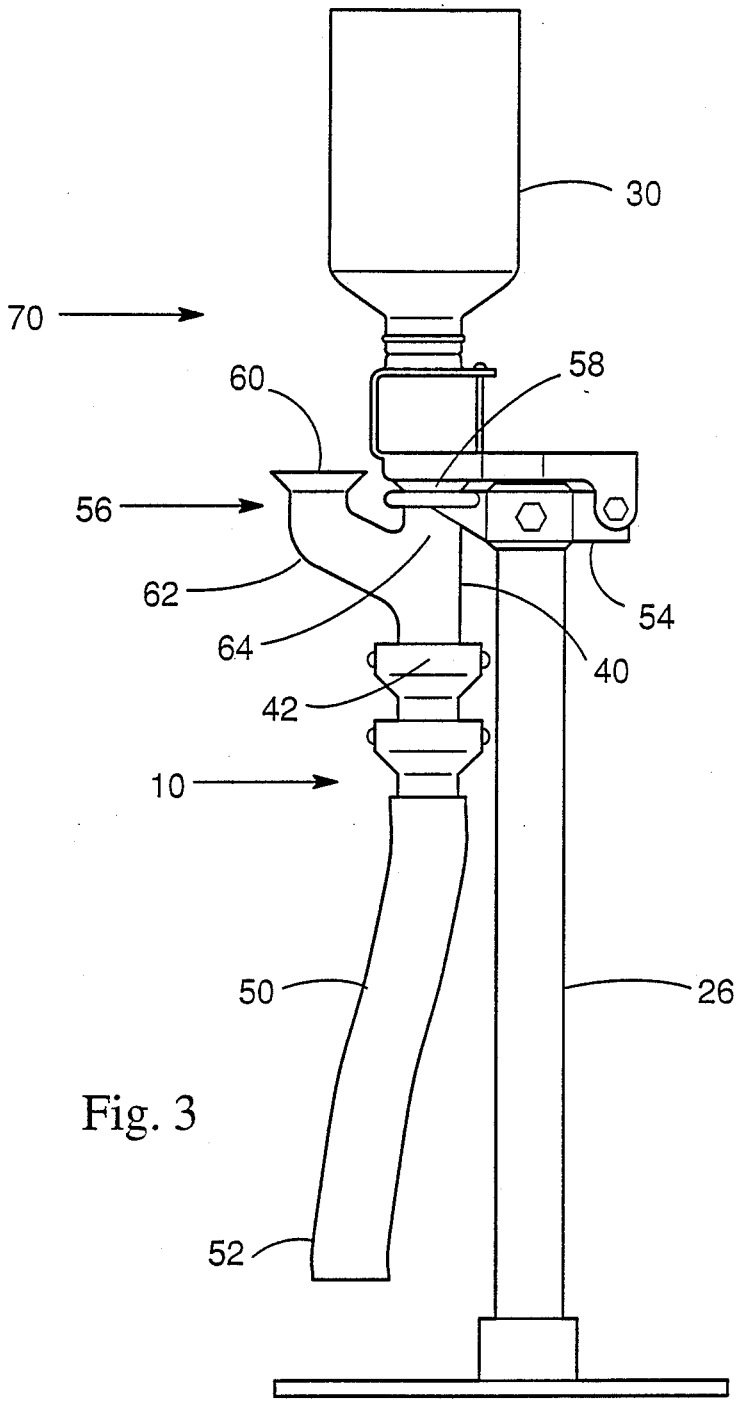
FIG. 3 is a side plan view of FIG. 2.
Figure 4:
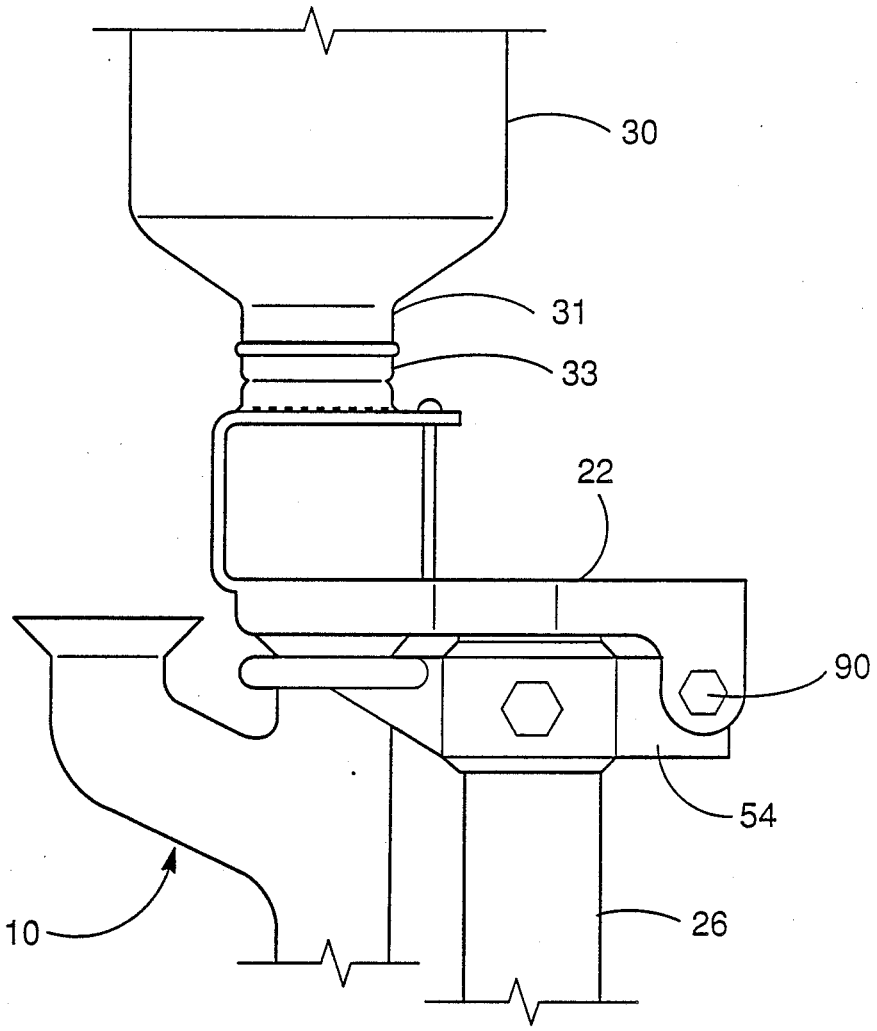
FIG. 4 is an enlarged view showing the measure resting on a support rod.

Attention is next directed to FIG. 3 which shows a side view of my dual shot loading accessory and FIG. 4 which is an enlarged view showing the mounting of the shot containers on the measure. A bracket 54 is mounted on and fixed to the top of upright support bar 26. This bracket 54 supports articulated drop tube 10. As shown in the drawings and especially FIG. 3, in a preferred embodiment there is a double funnel shot drop tube 56 just above funnel 42. This has a first funnel 58 which is positioned below the drop hole in the measure and a second funnel 60 which is connected to the tube 62 by a shot expansion chamber 64 which slopes downwardly from funnel 60 to tube 62.

If the larger shots are dropped into tube 40 rapidly there is a tendency for them to jam. Expansion chamber 64 will normally prevent all such jamming which may occur with the commonly used larger size shots. This jamming can be a problem in conventional shot loaders. I can relieve this jamming by replacing the conventional drop tube in such conventional loaders by use of double funnel shot drop tube. This has the double funnel 58 and 60, and shot expansion 64.

Figure 5:
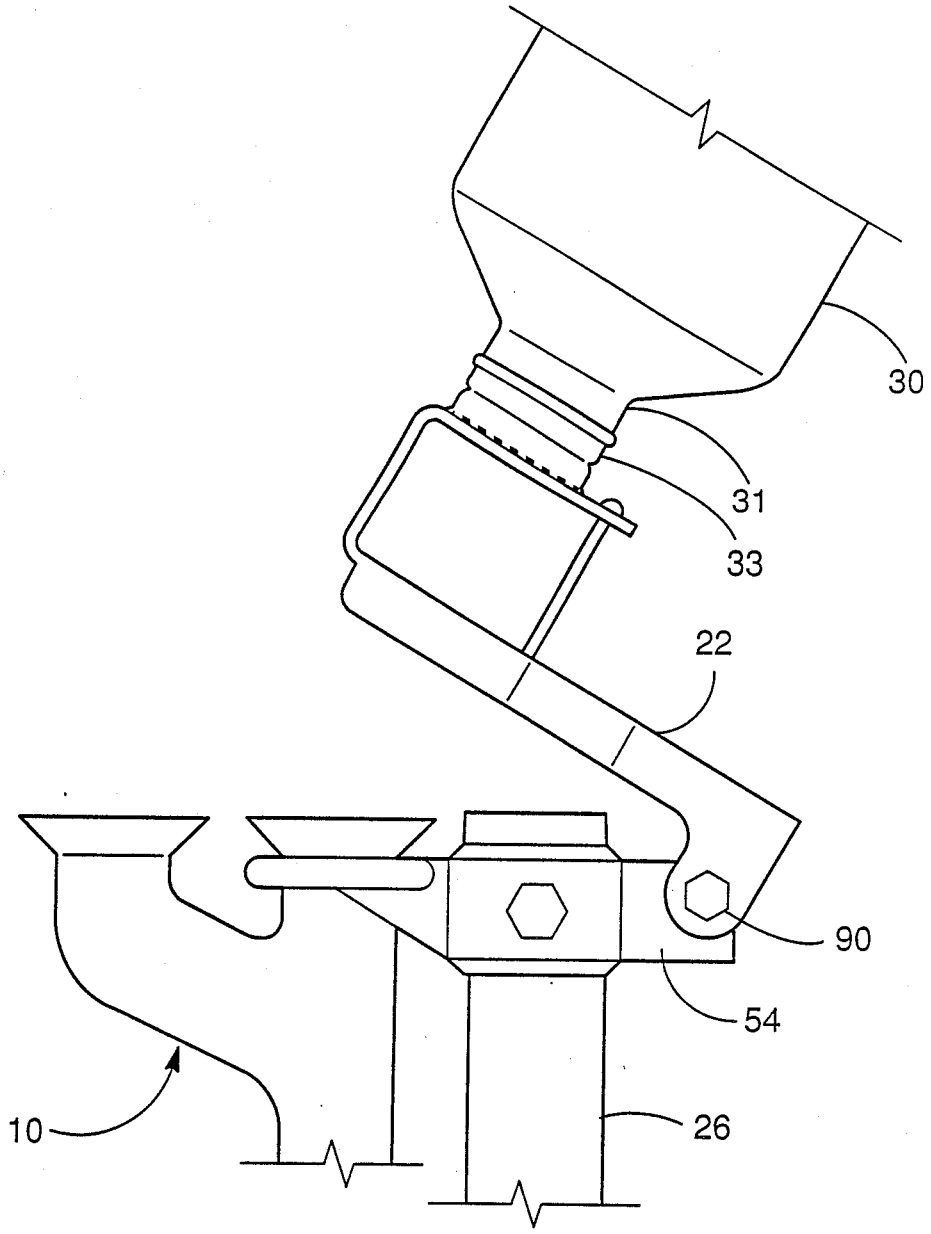
FIG. 5 is similar to FIG. 4 except the measure has been pivoted.
Figure 6:
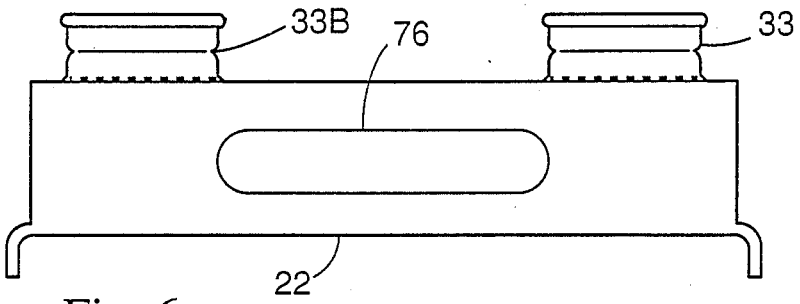
FIG. 6 is a front plan view of the measure.
Figure 7:
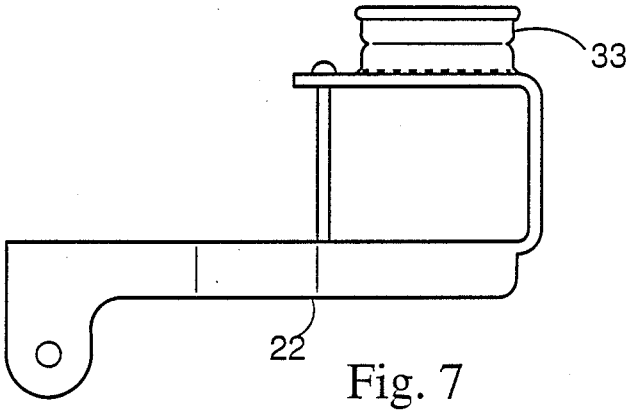
FIG. 7 is a side plan view of the measure.
Figure 8:
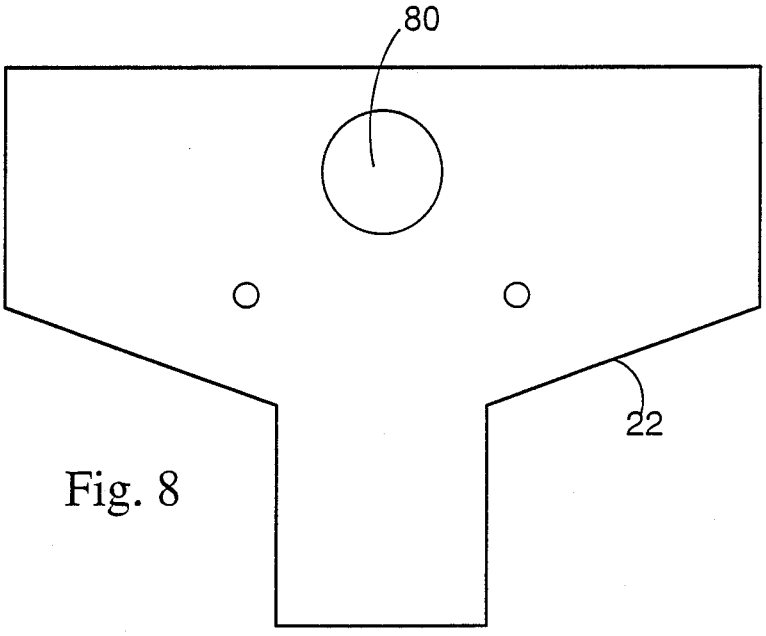
FIG. 8 is a bottom view of the measure.
Figures 10, 11, 12, 13:
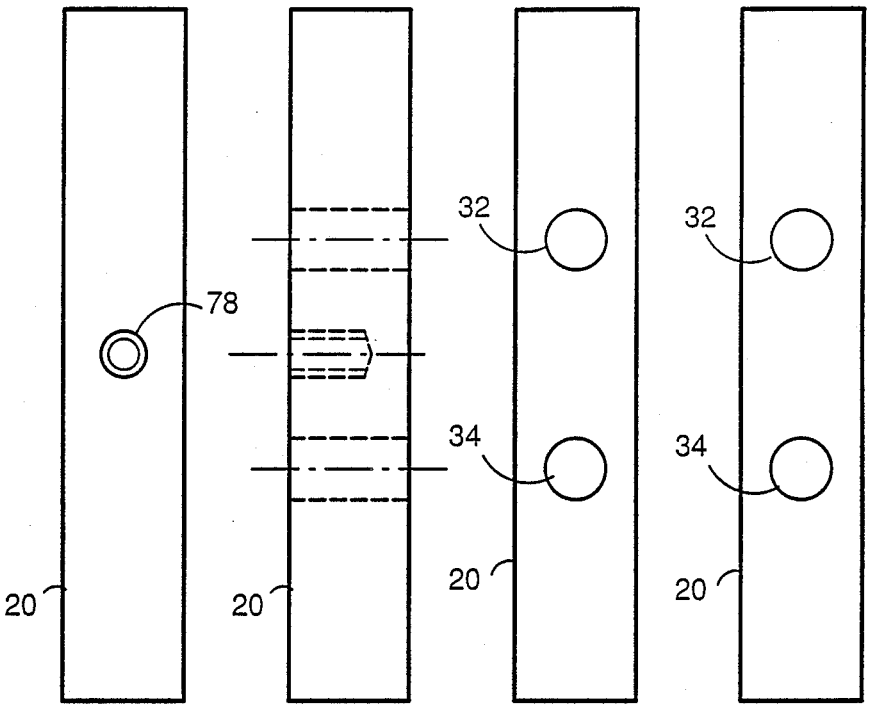
FIG. 10 is a front plan view of the measure charge bar.
FIG. 11 is a back plan view of the measure charge bar.
FIG. 12 is a top plan view of the measure charge bar.
FIG. 13 is a bottom plan view of the measure charge bar.
Figure 9:
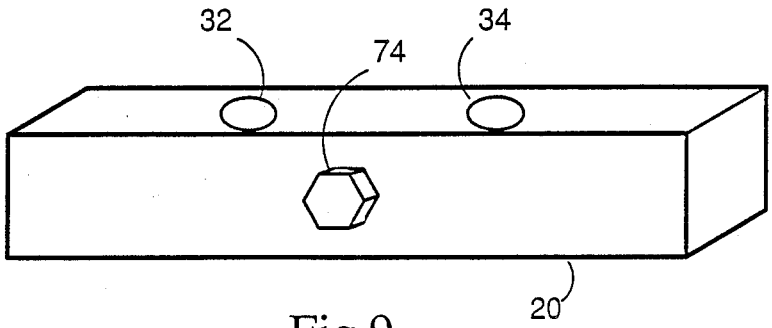
FIG. 9 is an isometric view of the measure charge bar.

Referring now to FIGS. 3, 4, 5, 6, 7 and 8, there is shown the measure which includes housing 22 which is pivoted at 90 to bracket 54. In FIG. 4 housing 22 rests on top of support rod 26. This is the loading position. When it is desired to put a full container 20 on the measure, the measure is pivoted above pivot 90 to where the container top 31 can be screwed onto the open cap 33 and 33B of the housing 22. After this the container is rotated as indicated in FIG. 5 back to the position shown in FIG. 4. A measure bar 20, shown in FIG. 9, is installed in housing of measure 22. A stop bolt 74 is screwed into the bar through slot 76 (FIG. 6) into threaded hole 78 (FIG. 10) after the bar 20 is inserted into the measure housing. Thus the bar can be slid between the positions shown in FIGS. 14 and 15. Bar 20 has a first shot measure chamber 32 and a second shot measure chamber 34, as shown in FIG. 9, 12 and 13. When the bar 20 is in the position of FIG. 14 chamber 34 is being loaded with shot from container 30 and the shot in chamber 32 is dropped by gravity through drop hole 80 in the bottom of measure housing 22 into the shot drop tube funnel 58. When the bar 20 is in the position shown in FIG. 15, shot from container 28 is filling chamber 32 and the shot in chamber 34 is dropping into drop tube funnel 58. Thus, I can place one size shot in chamber 30 and a different size shot in chamber 28 and obtain a dual size shot loading of shell hull 16 by manipulating the bar 20 as indicated in FIGS. 14 and 15 with my articulated drop tube 10.

Figure 16:
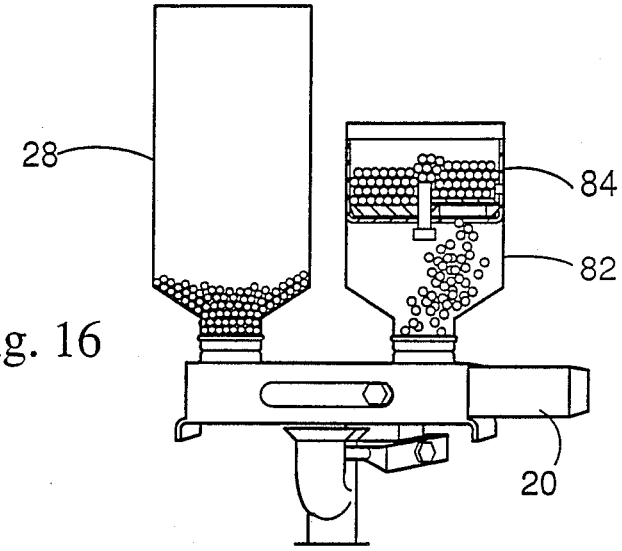
Figure 17:
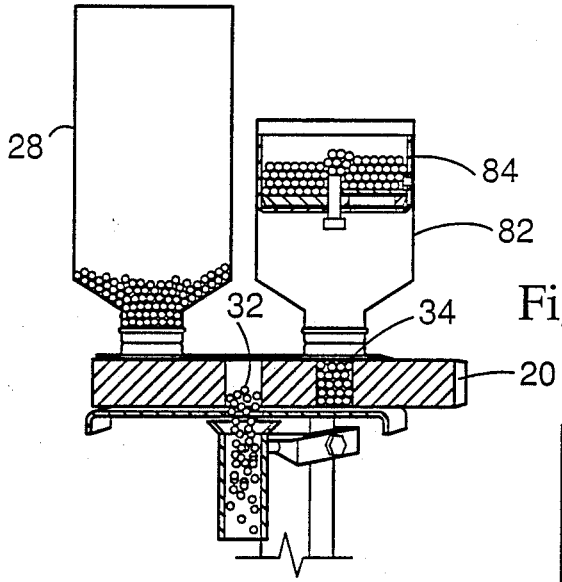
Figure 18:
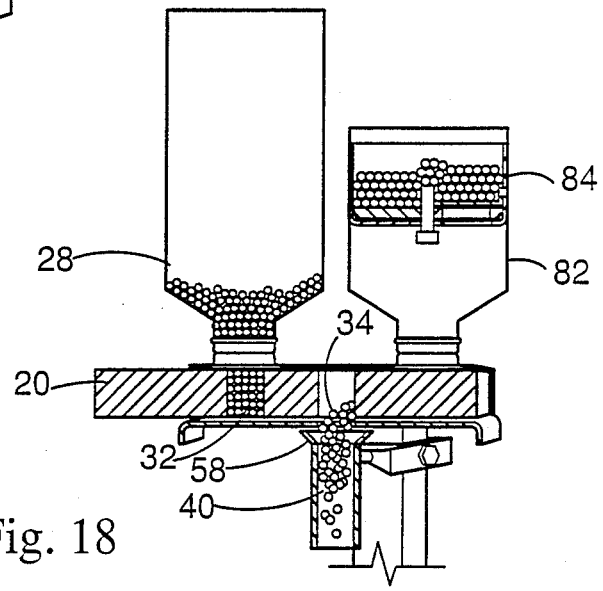
Figure 19:
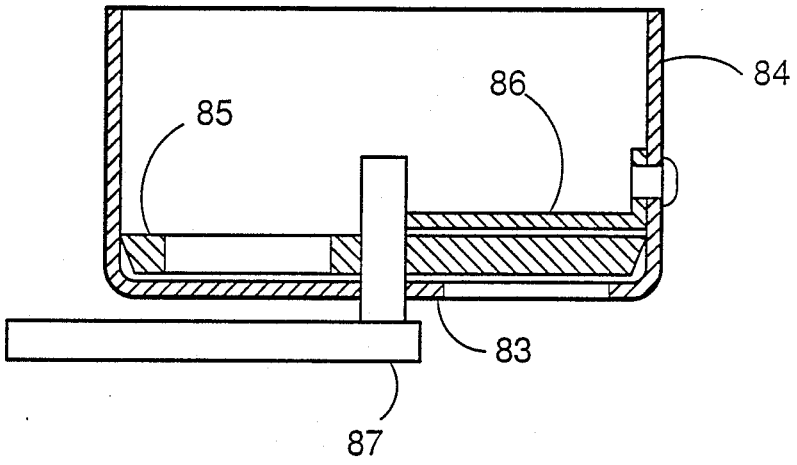
Figure 20:
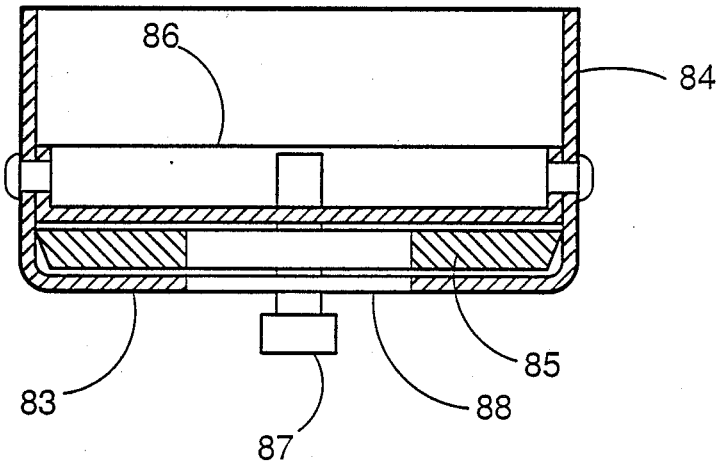
Figure 21:
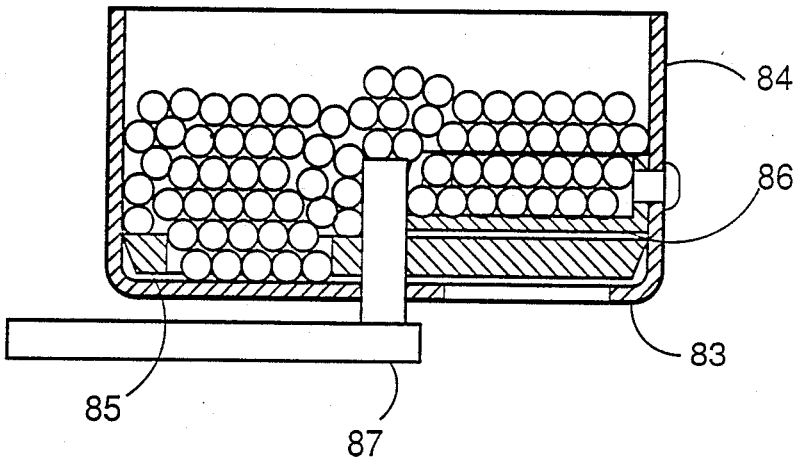
Figure 22:
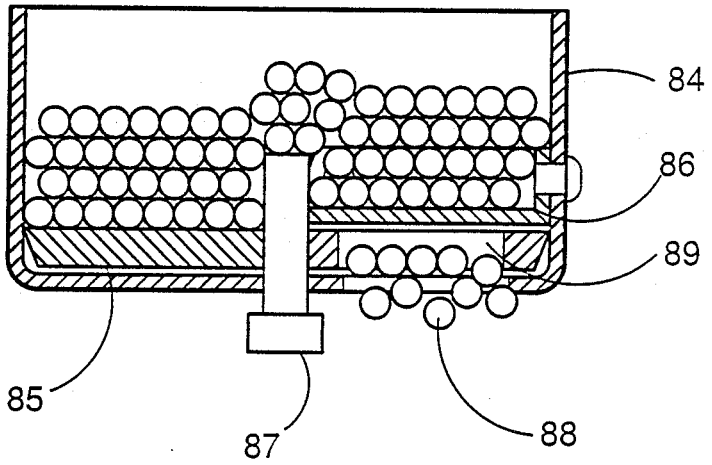
Figure 23A:
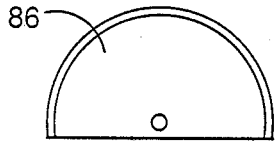
FIGS. 23A, 23B and 23C show the top, side and bottom of the cover plate.
Figure 23B:
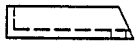
Figure 23C:
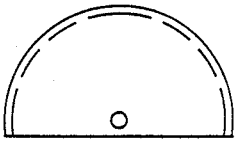
Figure 24A:
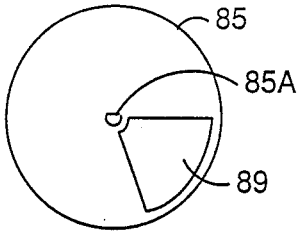
FIGS. 24A and 24B show the top and side view of the charge wheel.
Figure 24B:
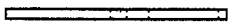
Figure 25A:
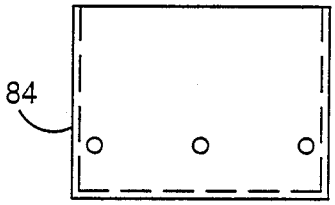
FIGS. 25A and 25B show the side and bottom view of the shot container.
Figure 25B:
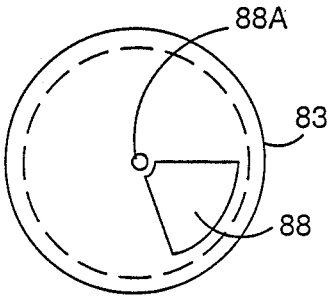
Figure 26A:
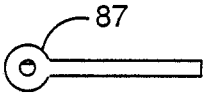
FIGS. 26A, 26B and 26C show the top, side and bottom of the lever used to rotate the charge wheel.
Figure 26B:
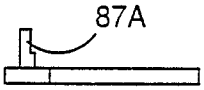
Figure 26C:
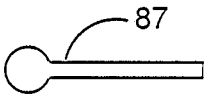
Figure 27A:
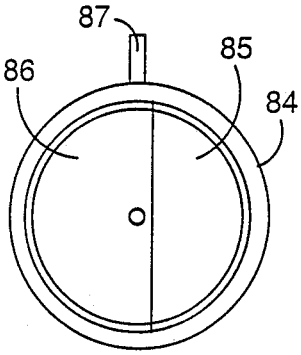
FIG. 27A shows a top view of the cover plate with charge plate.
Figure 27B:
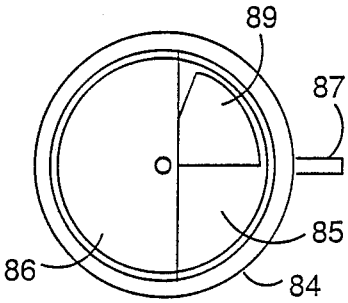
FIG. 27B is similar to FIG. 27A except the charge plate has been rotated 90°.
Figure 27C:
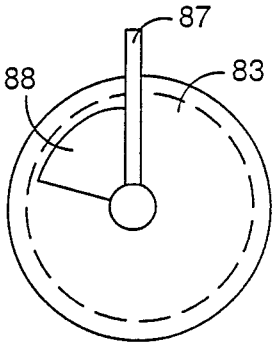

If either shot measure chambers 32 or 34 is made small to accommodate measuring a small load of shot, sometimes the shot may jam in the measuring chamber, especially for large shot such as 1 to TTT. I show a charge wheel system in FIGS. 16 to 27C which eliminates this problem. As shown in FIG. 16, container 84 has a charge wheel system for measuring shot from the top of the container to the bottom thereof and eventually into measuring chamber 34 which is not used as a measuring device but merely as a carrying chamber and thus can be large enough in diameter to prevent jamming of the large shot. Chamber 34 normally will not be filled but that is all right because the measuring is done by the charge wheel 85 as will be seen. Attention is now directed to FIG. 19 which shows the bottom portion of container 84. This includes a cover plate 86 fixed to the container. Charge wheel 85 is mounted between cover plate 86 and bottom 83 of the container 84. A handle 87 is used to rotate charge plate 85. The cover plate is shown in FIG. 23A, 23B and 23C, which are top, side and bottom respectively. The charge wheel is shown in FIGS. 24A and 24B which are the top and side view. The lever is shown in FIGS. 26A, 26B and 26C which are the top, side and bottom views, respectively. The side view of shot container is shown in FIGS. 25A and the bottom view in FIG. 25B which shows shot drop hole 88. Charge wheel 85 has a charge slot or slice 89. Cover plate 86 covers about one-half the cross-sectional area of container 84. The upright arm 87A of lever 87 passes up through a hole in bottom 83 and non-circular hole 85A in the charge plate through the circular hole in cover plate 86. The arm 87A is held in place by any well known means such as a pin laterally through it just above the cover plate. Arm 87A also rotates in hole 88A in the bottom of shot container 84. However, rotation of the handle rotates charge plate 85 inasmuch as arms 87A is fitted snugly within non-circular hole 85a. Alternatively, arm 87A could be glued to charge plate 85.

Figure 28:
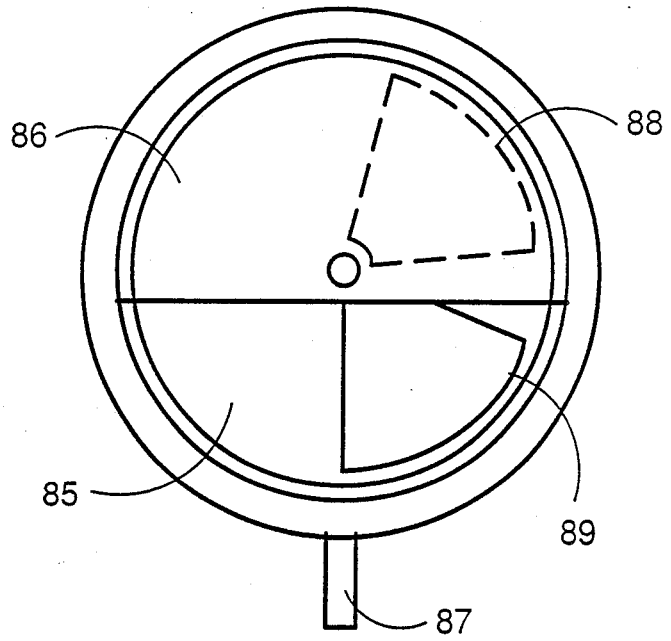
FIG. 28 illustrates the cover plate over the shot drop hole.
Figure 29:
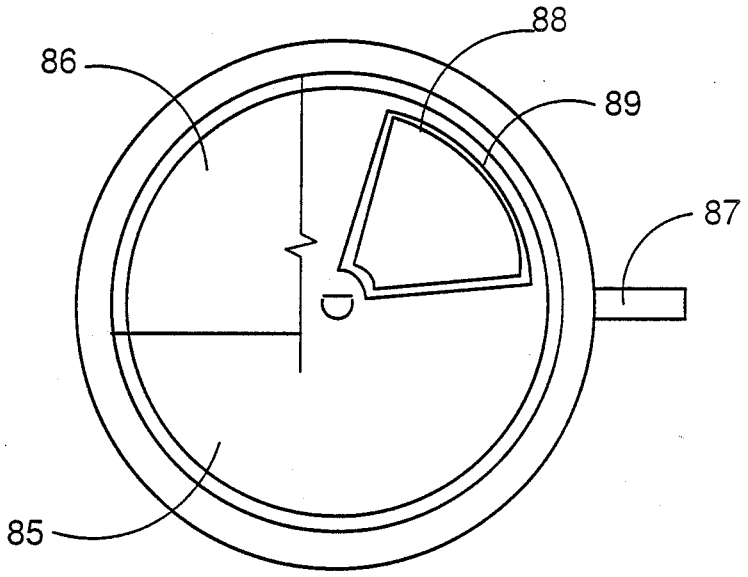
FIG. 29 shows the charge wheel rotated 90° from the position shown in FIG. 28.

As shown in FIGS. 28 and 29, the cover plate 86 is above or covers the shot drop hole 88 in container bottom 83. When lever 87 is in the position shown in FIGS. 27 and 21 the charge wheel opening 89 is not over the shot drop hole. However, opening 89 is not covered by cover plate 86 so that space 89 in the charge wheel 85 is filled with shot. When lever 87 is moved to the position shown in FIGS. 28 and 22, shot measure space 89 is under cover plate 86 and directly over shot drop hole 88 in the bottom m83 of shot container 82. The amount of shot dropped is determined by the size of shot measure space or slot 89. There is no danger of jamming inasmuch as shot drop hole 88 is the same shape and size as shot measure space 89. In this system there is no measuring requirement of hole 34 in bar 20 so it can be large enough to prevent jamming. In operation, when bar 20 is in the position shown in FIG. 17 I merely work lever 87 as described above and illustrated in FIGS. 21 and 22 to put the number of shots into hole 34 of bar 20 as determined by the size of space 89 in charge wheel 85. By moving the bar 20 to the left the shot in hole 34 is dropped into the drop tube and hole 32 of the bar 20 is being filled. A smaller size shot would be placed in container 28 from that in container 82 so that there should be no jamming problem in hole 32.

Figure 30:
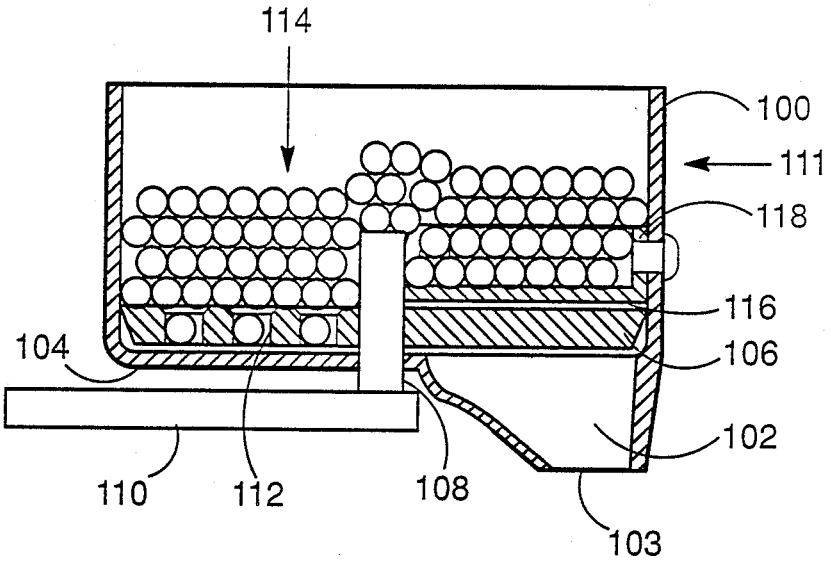
FIG. 30 is a view, partly in section, of the preferred embodiment of my charge system.
Figure 35:
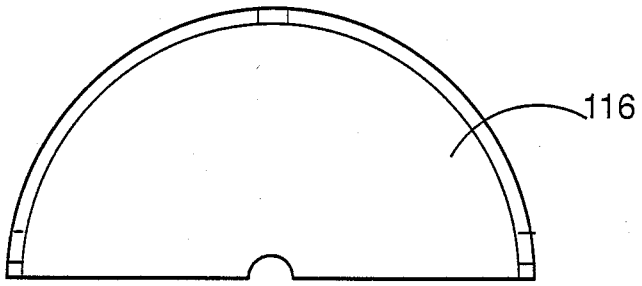
FIG. 35 is a top view.
Figure 36:
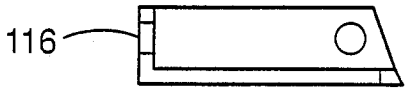
FIG. 36 is a side view and FIG. 37 is a front view of the cover plate with the embodiment of FIG. 34.
Figure 37:
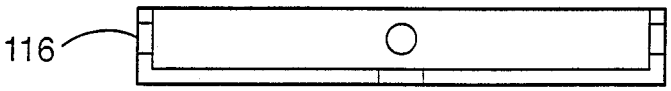
Figure 38:
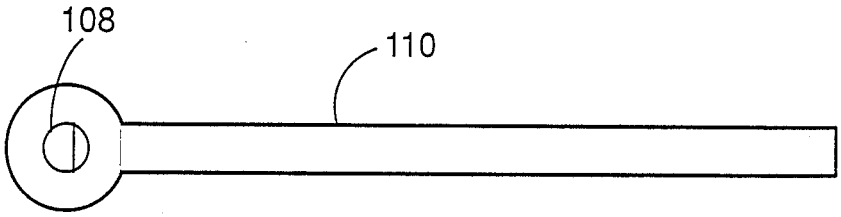
FIGS. 38, 39 and 40 are a top view, a side view and a bottom view of the handle used to rotate the charge wheel of the embodiment of FIG. 30.
Figure 39:
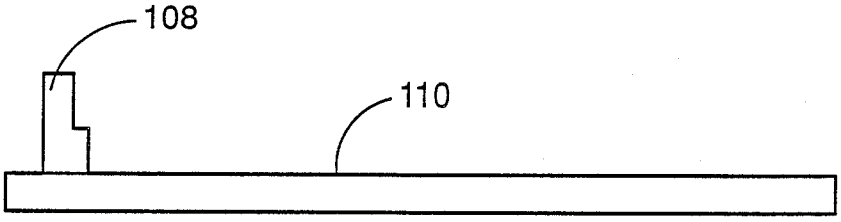
Figure 40:
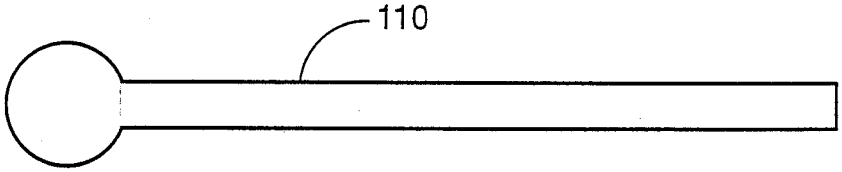
Figure 41:
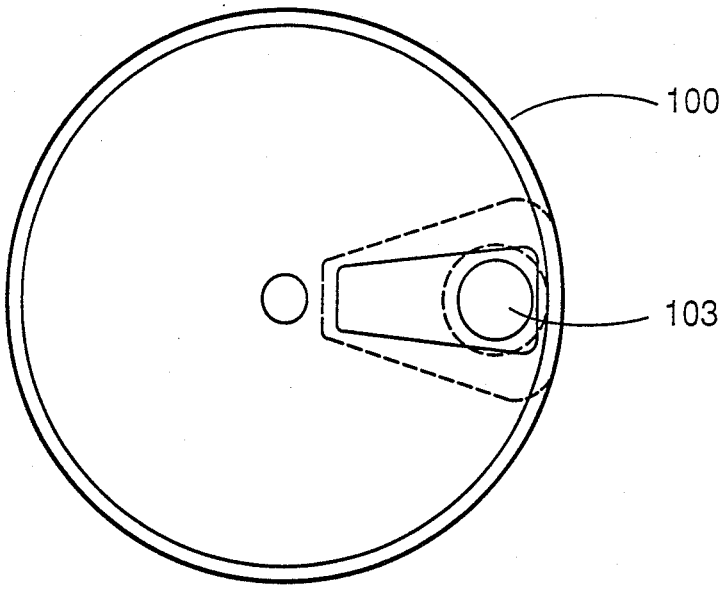
FIGS. 41, 42 and 43 are top, side and bottom views of the container of the embodiment of FIG. 30.
Figure 42:
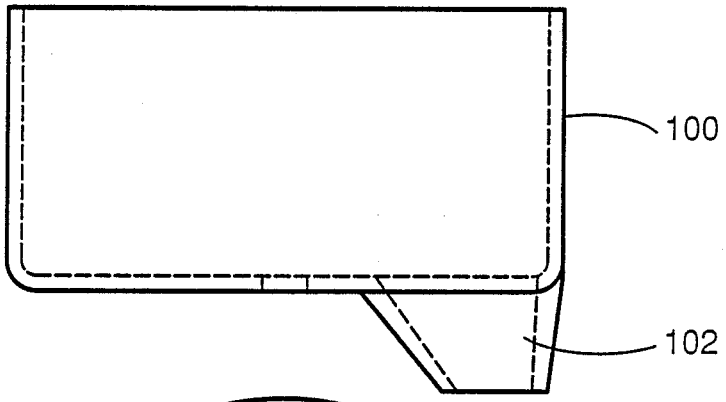
Figure 43:
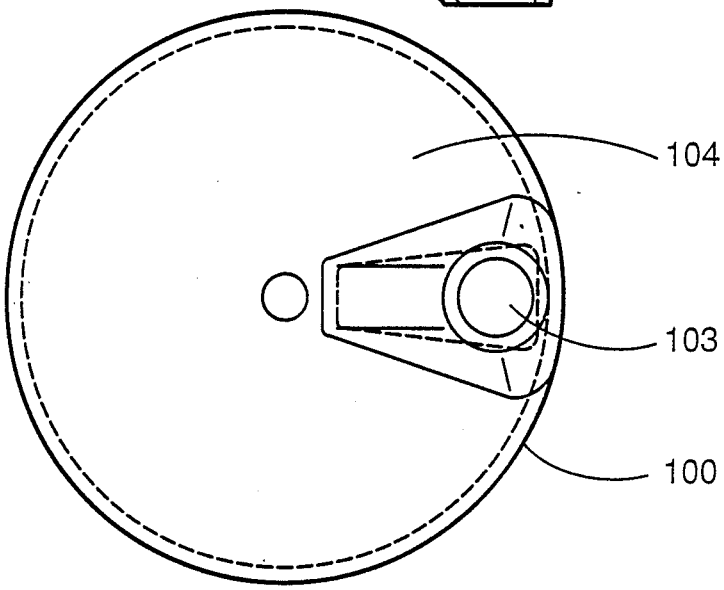

Attention is next directed to my preferred embodiment shown in FIGS. 30 through 44. FIG. 30 shows a first dispenser 111 with container 100 with a shot drop tube 102 in bottom 104. A rotatable charge wheel 106 is supported within the container by stem 108 of handle 110. Stem 108 is rotatably supported by bottom 104 but charge wheel 106 is fixed to stem 108 so that charge rotation of stem 108 also rotates charge wheel 106. Charge wheel 106 has a plurality of shot receiving holes 112. The thickness of wheel 106 and the size of holes 112 are such that each hole receives one and only one of shot 114. If a second size shot is loaded into a shell hull, then a second wheel is obtained which would have holes of a size to receive that second size shot. The cover plate 116 is shown in FIGS. 35, 36 and 37 and is held in position by bolt or screw 120 extending through the wall of the container and stem wall 118 of the cover plate. The cover plate covers about ½ of the area of the cross-section of the container of a plane defined by the cover plate. FIG. 42 shows a front or side view of shot container 100. FIGS. 41 and 43 show shot drop hole 103 in shot drop tube 102. FIGS. 38, 39 and 40 show the top, side and bottom view of handle 110.

Figure 2:
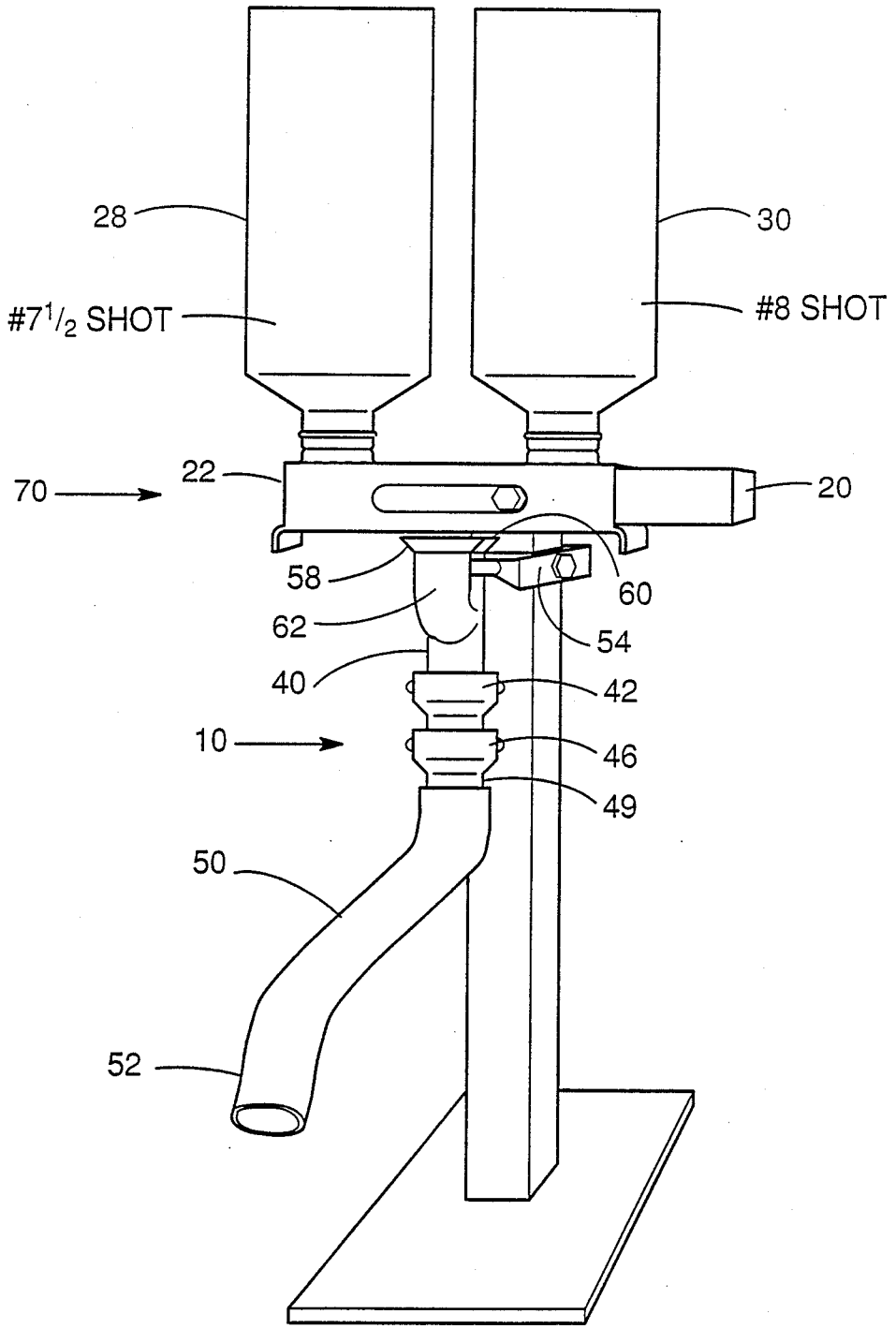
FIG. 2 is a front plan view of my accessory for two level shot loader.
Figure 44:
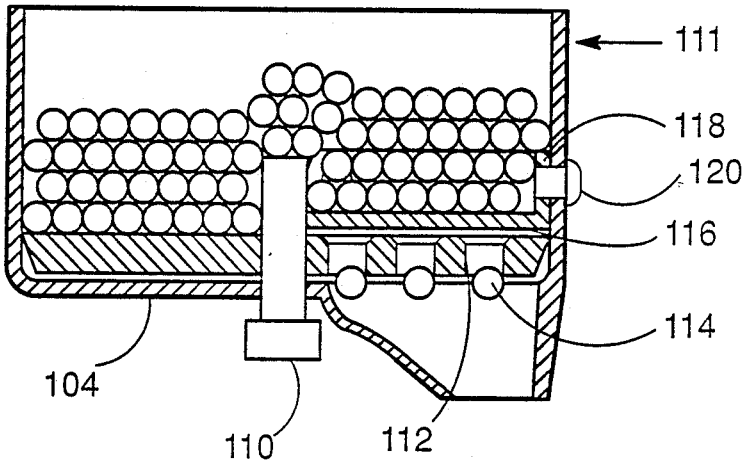
FIG. 44 is similar to FIG. 30 except the charge wheel has been rotated 270°.
Figure 31:
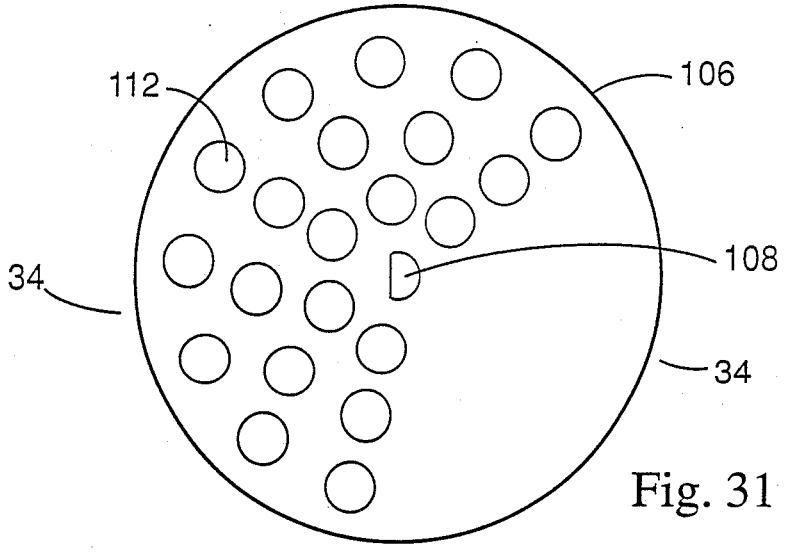
FIG. 31 is a top view of my new charge wheel.
Figure 32:
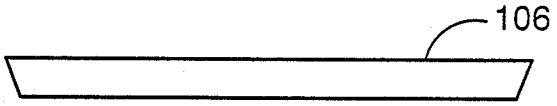
FIG. 32 is a side view of my new charge wheel.
Figure 33:
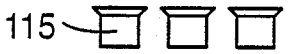
FIG. 33 is a side view of the plug.
Figure 34:
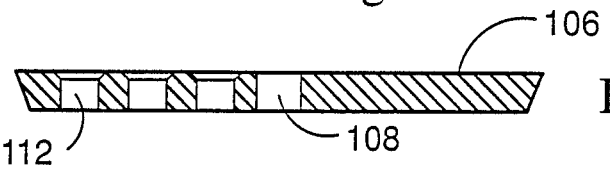
FIG. 34 is a section view along midline 34—34 of FIG. 31.
Figure 45:
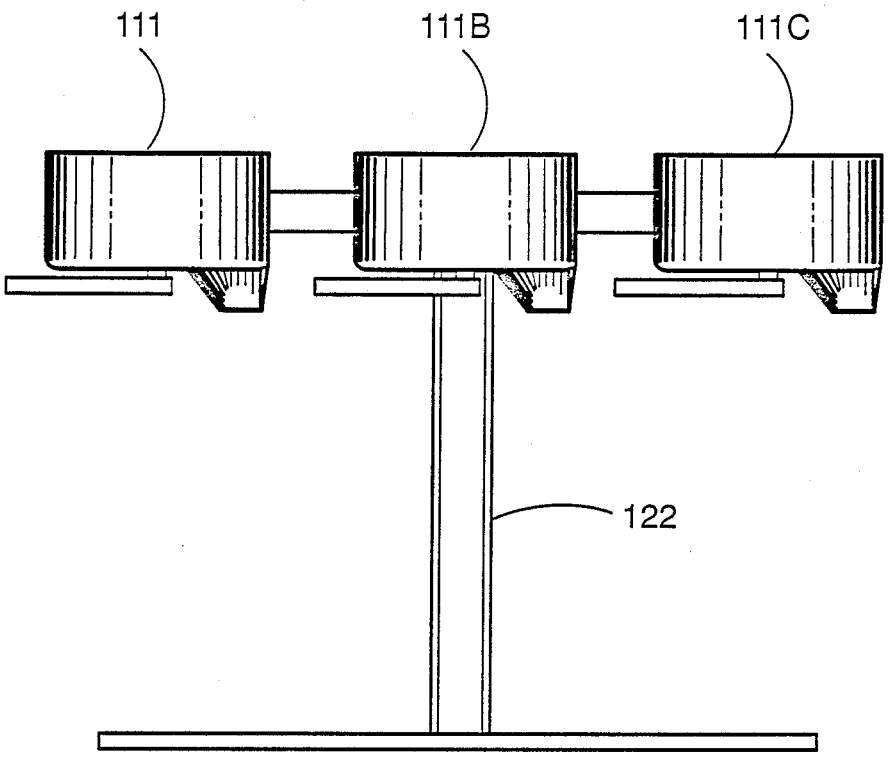
FIG. 45 shows a stand supporting three dispensers of the embodiment of FIG. 30.

Attention is now directed to FIGS. 30 and 44. FIG. 30 shows holes 112 out from under cover plate 116 and exposed to the shot in container 100. A shot 114 settles into each hole 112. Handle 110 is rotated so that the holes 112 pass over shot slot 102 where the shots drop through hole 103 to a shell hull positioned beneath such hole. The exact number of shots thus dropped is determined by the number of holes 112 in the charge plate. If the holes 112 are all located in ½ of the charge plate, then rotating handle 110 180° and the reverse rotating would load each hole and empty each hole. By proper selection and spacing of holes 112 and controlling the rotation of charge wheel 106 one can obtain the amount of charge loaded into each shell hull located below shot drop hole 103. The amount of shot dispensed can also be detected by use of individual plugs placed in charge wheel 106. Attention is directed to FIG. 33 showing the individual plugs. When plug 115 is inserted in charge wheel hole 112 this hole is blocked and the shot charge reduced by one pellet. This can be done in a desired number of holes to control the amount of shot dropped into tube 103. FIG. 45 shows three shot dispensers 111, 111B, and 111C. Each is similar to that dispenser described above with regard to FIGS. 30 and 43 except that each is designed for a different size shot from that of the others. This permits three level shot loading. The shell hull is held progressively under the shot hole of dispenser 111, then 111B and then 111C to obtain three different size shot loading. This accessory just described can be used with a load tube such as load tube 50 shown in FIG. 2.

While the invention has been described with a certain degree of particularity, it is manifest that many charges may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full rage of equivalency to which each element thereof is entitled.

What I claim:

1. An accessory for loading shotgun shell hulls comprising; a shot container having a bottom with a shot drop hole therein; a cover plate fixed to an inner wall of the shot container and covering a portion of the shot container's cross-sectional area; a charge wheel rotatably supported between the bottom of the shot container and the cover plate and having a plurality of shot receiving holes extending therethrough; and a means to rotate said charge wheel from a position wherein said shot receiving holes are exposed from under said cover plate to a position wherein said shot receiving holes are covered by said cover plate and over said drop hole in the bottom of said shot container.

2. An accessory as defined in claim 1, wherein said covered portion of said shot container's cross-sectional area is about ½ said cross-sectional area.

3. An accessory as defined in claim 2, including a stand for supporting a plurality of shot containers in a fixed pattern, and wherein each shot container has a charge wheel having shot receiving holes of different size from the shot receiving holes of the charge wheels of the other shot containers.

* * * * *